US007003919B2

(12) United States Patent
Riker

(10) Patent No.: US 7,003,919 B2
(45) Date of Patent: Feb. 28, 2006

(54) POST MOUNT ASSEMBLY

(75) Inventor: Ronald D. Riker, Brownwood, TX (US)

(73) Assignee: Caminoverde II, L.L.P., Hutto, TX (US)

( * ) Notice: Subject to any disclaimer, the term of this patent is extended or adjusted under 35 U.S.C. 154(b) by 130 days.

(21) Appl. No.: 10/248,703

(22) Filed: Feb. 11, 2003

(65) Prior Publication Data

US 2003/0121223 A1 Jul. 3, 2003

(51) Int. Cl.
*E02D 27/42* (2006.01)

(52) U.S. Cl. ..... 52/170; 52/298; 52/296

(58) Field of Classification Search ..... 52/296, 52/292, 298, 169.13, 170; 248/159, 548; 405/231, 244, 256, 232, 249; 254/104; 285/339, 285/342

See application file for complete search history.

(56) References Cited

U.S. PATENT DOCUMENTS

| | | | | | |
|---|---|---|---|---|---|
| 306,657 | A | * | 10/1884 | Stephen | 52/297 |
| 335,534 | A | * | 2/1886 | Hester et al. | 84/335 |
| 533,676 | A | * | 2/1895 | Singley | 52/297 |
| 905,794 | A | * | 12/1908 | Crego | 52/297 |
| 1,553,785 | A | * | 9/1925 | Ley | 52/297 |
| 3,385,565 | A | * | 5/1968 | Cuthbert | 256/13.1 |
| 4,095,826 | A | * | 6/1978 | Borradori | 285/330 |
| 4,373,303 | A | | 2/1983 | Stratichuk | |
| 4,598,512 | A | | 7/1986 | Chapman | |
| 4,649,678 | A | | 3/1987 | Lamson | |
| 4,793,110 | A | * | 12/1988 | Tucker | 52/297 |
| 4,926,785 | A | * | 5/1990 | Lamson | 116/209 |
| 5,104,265 | A | | 4/1992 | Halloran, Jr. | |
| 5,165,663 | A | | 11/1992 | Wells | |
| 5,253,520 | A | * | 10/1993 | Drexel et al. | 73/202 |
| RE35,133 | E | | 12/1995 | Halloran, Jr. | |
| 5,535,559 | A | * | 7/1996 | Nielsen et al. | 52/199 |
| 5,625,988 | A | * | 5/1997 | Killick | 52/298 |
| 5,690,316 | A | * | 11/1997 | Madjarac | 254/104 |
| 5,752,349 | A | | 5/1998 | Fitzsimmons et al. | |
| 6,041,559 | A | | 3/2000 | Schickert et al. | |
| 6,202,369 | B1 | * | 3/2001 | Partee et al. | 52/165 |
| 6,343,446 | B1 | | 2/2002 | Beard | |
| 6,390,139 | B1 | * | 5/2002 | Kang et al. | 138/120 |
| 6,471,578 | B1 | * | 10/2002 | Yang | 454/21 |
| 6,494,643 | B1 | | 12/2002 | Thurner | |
| 6,595,721 | B1 | * | 7/2003 | Kincheloe | 405/125 |

OTHER PUBLICATIONS

Northwest Pipe Company, Poz–Loc Internet Web Pages (5 total).

* cited by examiner

*Primary Examiner*—Brian E. Glessner
(74) *Attorney, Agent, or Firm*—Daniel V. Thompson

(57) ABSTRACT

A post and post mount assembly in a hole in the ground has a socket in the hole, concrete in the annular space between the interior walls of the hole and the exterior of the socket, a post in the socket, a wedge member having a tapered portion filling a gap between the socket and the post.

10 Claims, 5 Drawing Sheets

POST MOUNT ASSEMBLY

BACKGROUND OF INVENTION

The present invention relates in general to sign post mounts. More specifically, but without restriction to the particular use which is shown and described, this invention relates to sign post support mounts that incorporate tubular sockets and driven-in fasteners.

Sign post mounts are known in the art. Conventional sign post mounts are a tubular device that is fixed in concrete or driven into the ground to receive the sign post and mount the sign post in an upright position. A driven-in fastener is often used to attach the sign post to the in-ground post mount to secure the sign post in the upright position. Many known post mount systems, however, are prone to loosening, tilting and/or rotation due to wind loading, temperature changes or impact on the sign post. Another known problem with existing post mounts is the hazard that arises from use of sharp and abruptly-edged metal components. Accordingly, there is a need for an improved post mount for mounting sign posts in the ground that provides better stabilization of the sign post and reduced hazard. The present invention provides a solution to these and other known problems common to conventional post mounts.

SUMMARY OF THE INVENTION

A post and post mount assembly in a hole in the ground has a socket in the hole, concrete in the annular space between the interior walls of the hole and the exterior of the socket, a post in the socket, a wedge member having a tapered portion filling a gap between the socket and the post.

BRIEF DESCRIPTION OF DRAWINGS

A more complete understanding of the invention and its advantages will be apparent from the Detailed Description taken in conjunction with the accompanying Drawings, in which.

DETAILED DESCRIPTION

Figure 1:
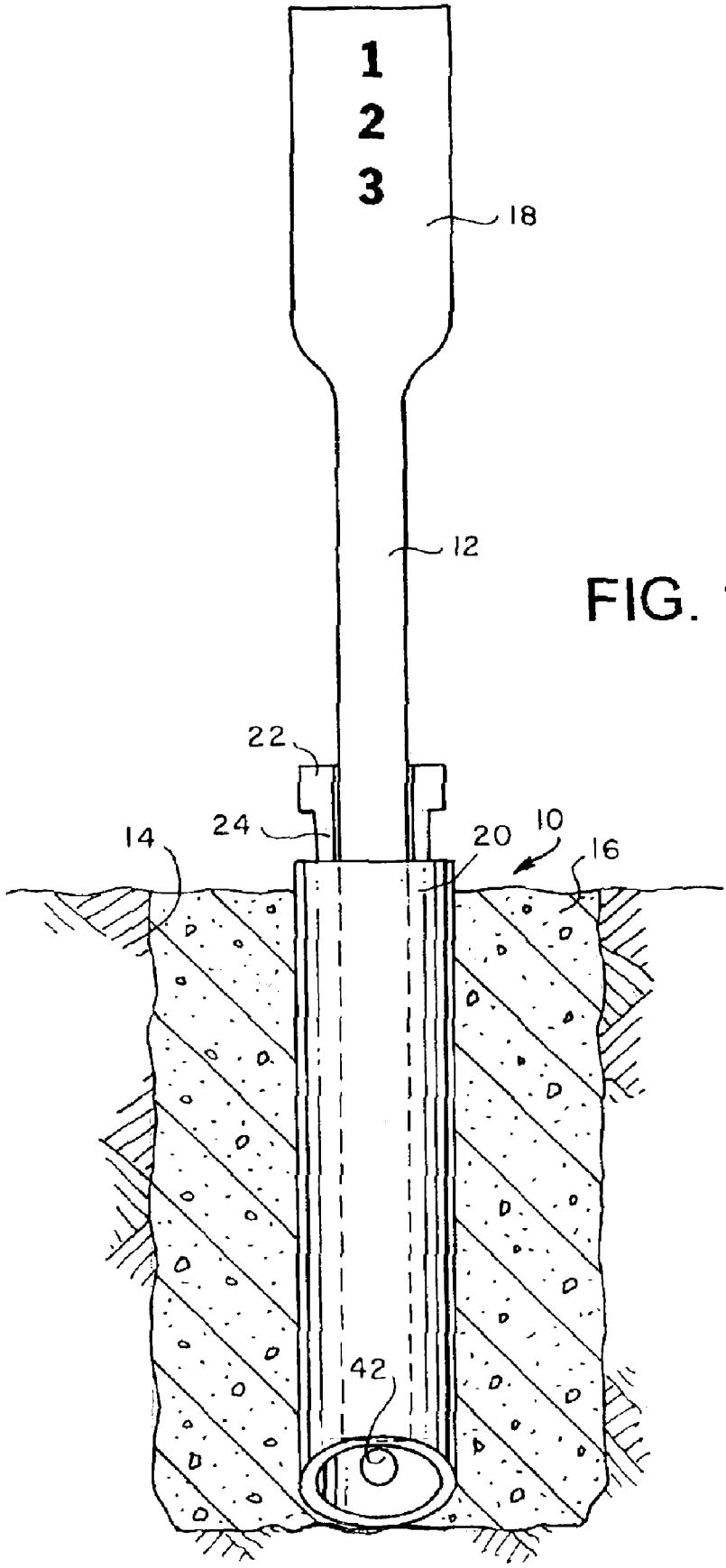
FIG. 1 is a partially broken away front elevation view of the post mount assembly of the present invention.
Figure 2:
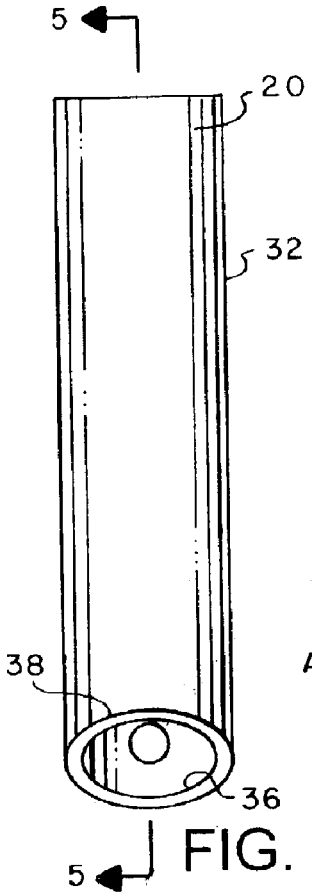
FIG. 2 is a front view of a socket used in the present invention.
Figure 3:
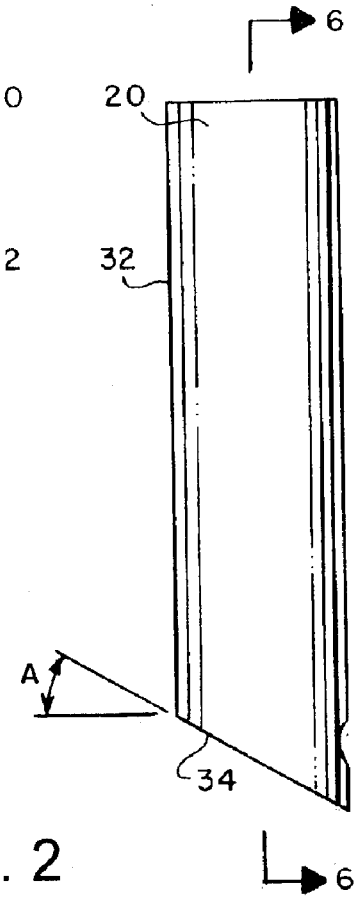
FIG. 3 is a side view of the socket of FIG. 1.
Figure 4:
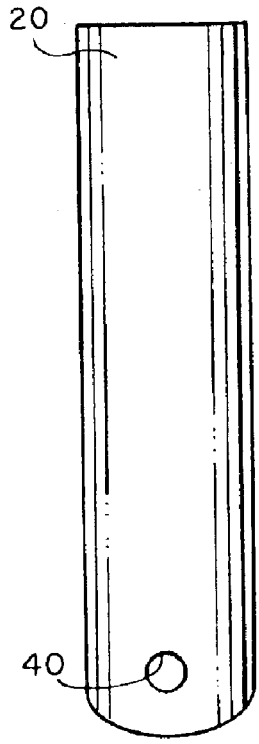
FIG. 4 is a back view similar of the socket of FIG. 1.
Figure 5:
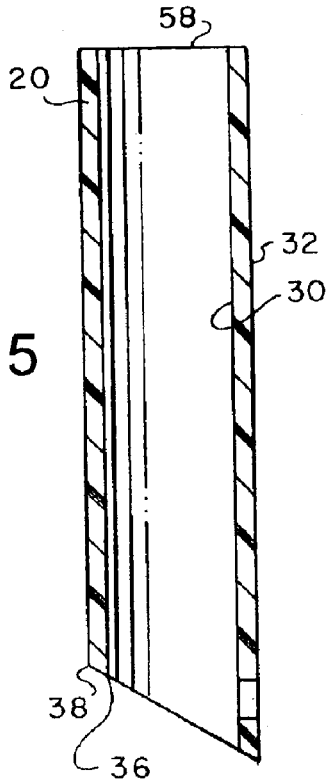
FIG. 5 is a sectional view taken along lines 5—5 of FIG. 2.
Figure 6:
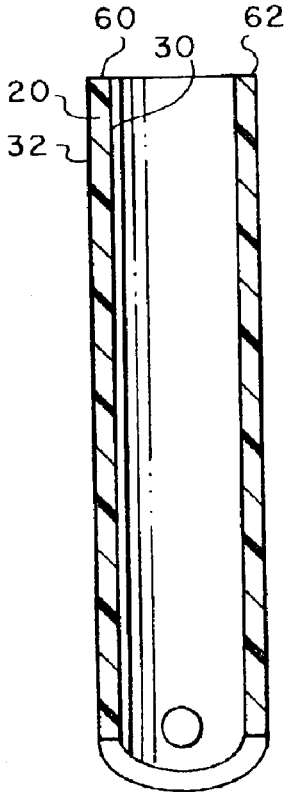
FIG. 6 is a sectional view taken along lines 6—6 of FIG. 3.

In its simplest aspect, the post mount assembly of the present invention includes a socket 20 in the hole 14, concrete 16 in the annular space between the interior walls of the hole 14 and the exterior of the socket 20, a post 12 in the socket 20, and a wedge member 22 having a tapered portion 24 filling a gap between the socket 20 and the post 12.

Socket 20 is a cylindrical tube with coaxial, parallel inner and outer walls 30, 32 respectively. Socket 20 has a lower end 34 at an oblique angle "A" to the inner and outer walls 30, 32. Lower end 34 of the socket 20 has inner and outer elliptical edges, 36, 38 respectively. Preferably, the oblique angle "A" of the socket lower end 34 is about thirty degrees from perpendicular to the inner and outer walls 30, 32.

Figure 7:
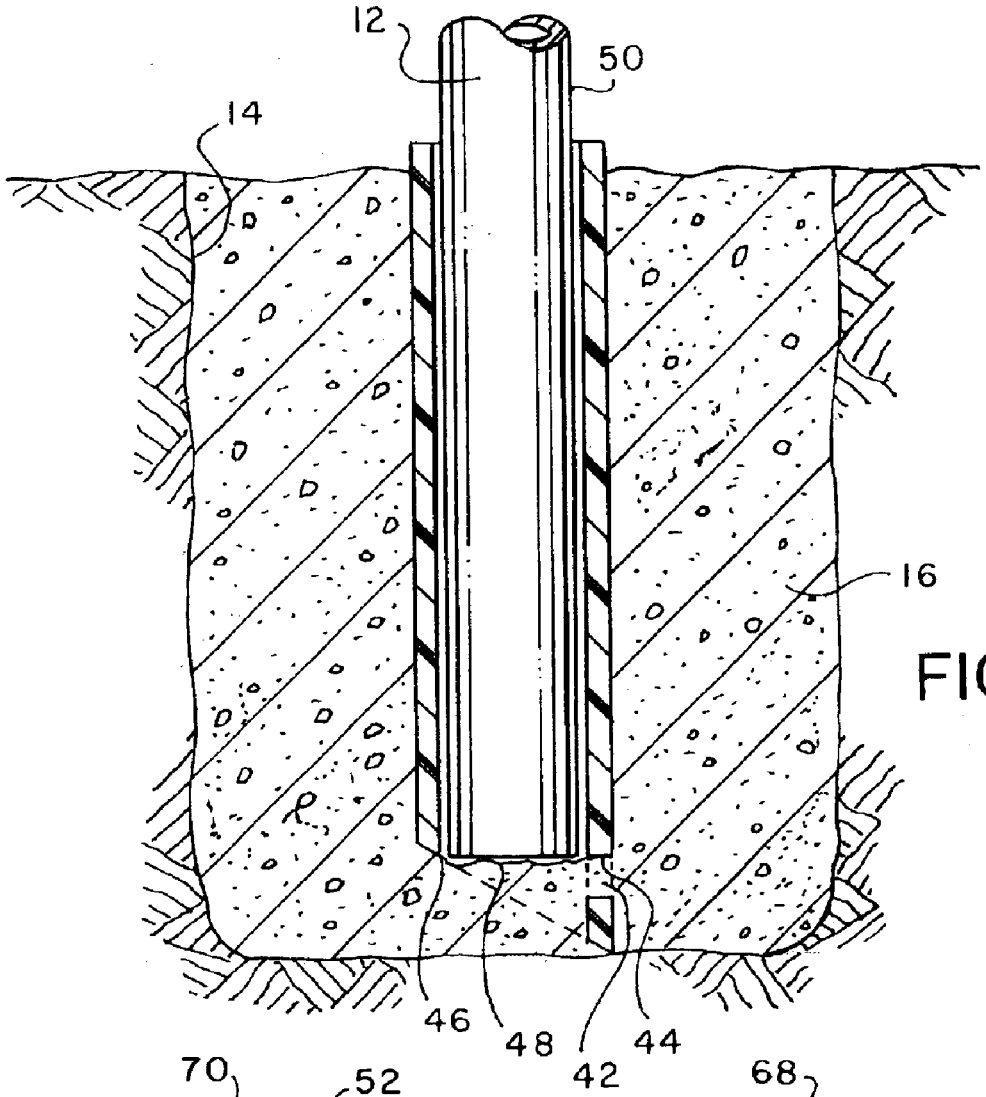
FIG. 7 is a partially broken away side elevation view of the bottom of the post mount assembly of the present invention.
Figure 8:
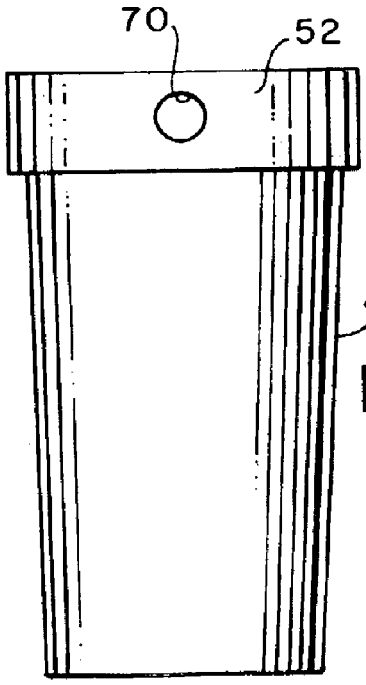
FIG. 8 is a front view of a wedge member used in the present invention.
Figure 9:
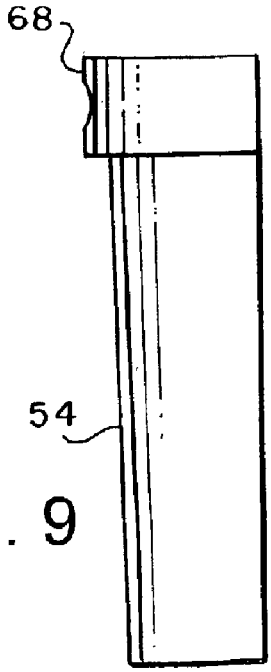
FIG. 9 is a side view of the wedge member of FIG. 8.
Figure 11:
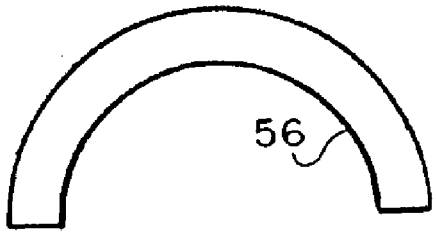
FIG. 11 is a top view of the wedge member of FIG. 8.
Figure 10:
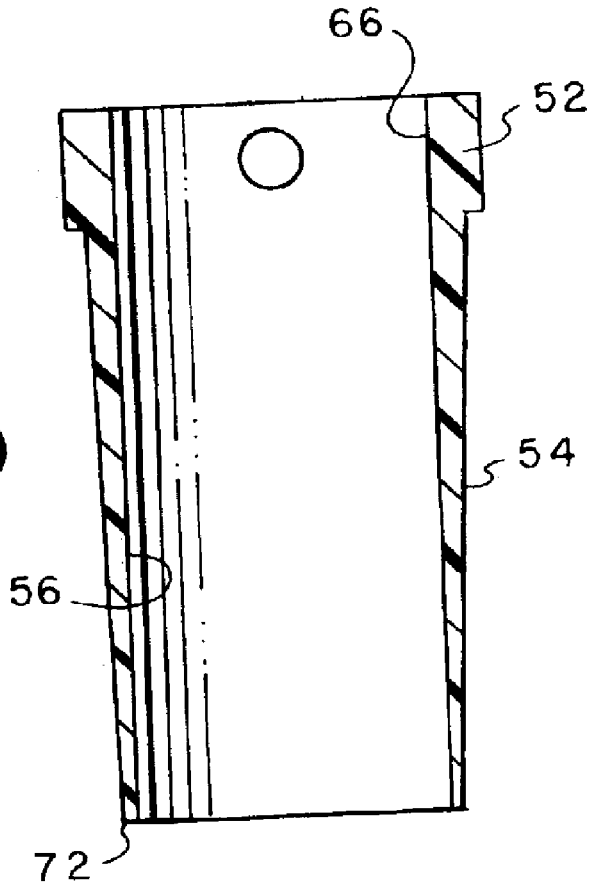
FIG. 10 is a back view of the wedge member of FIG. 8.
Figure 12:
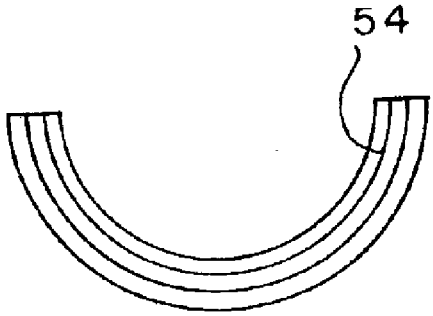
FIG. 12 is a bottom view of the wedge member of FIG. 8.

Socket 20 has walls 40 defining a locking port 42. Preferably, locking port 42 is defined in the lower end 34 of the socket 20 with cylindrical, horizontal walls 40. As best shown in FIG. 7, the uppermost portion 44 of the locking port 42 is about level with the uppermost portion 46 of the inner elliptical edge, with concrete 16 forming a floor 48 within the socket lower end 34 about level with the uppermost portion 44 of the locking port 42 and extending through the locking port 42.

Concrete 16 in the annular space between the interior walls 14 of the hole and the exterior of the socket 20 forms a contiguous mass with the concrete in the locking port 42, thereby locking the socket from removal and rotation. Locking port 42 adds additional, optional rigidity to the assembly that may be preferred, although it will be appreciated that the oblique angle "A" of lower end 34 alone will provide enhanced rigidity even in the absence of a locking port.

Figure 13:
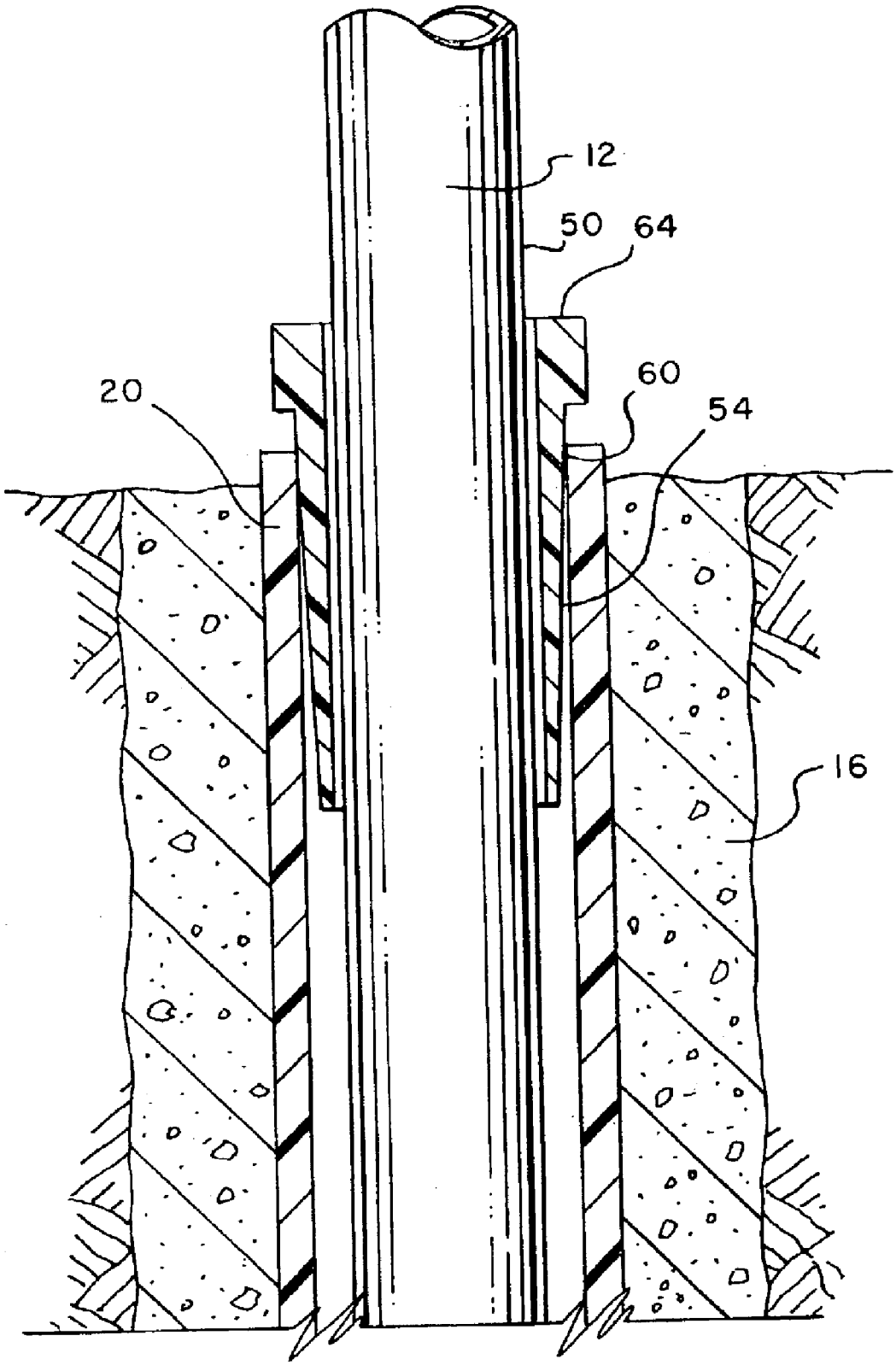
FIG. 13 is a partially broken away side elevation view of the top of the post mount assembly of the present invention.

The post 12 is cylindrical, having an exterior wall 50 sized with a diameter smaller than the inner wall 34 of the socket 20. Wedge member 52 has a bottom with a half frustro-conical outer wall 54 and a half-cylindrical inner wall 56. The upper end 58 of the socket 20 has inner and outer circular edges 60, 62 respectively. The half frustro-conical outer wall 54 is tightly engaged with socket upper end inner circular edge 60 and the post exterior wall 50, as best shown in FIG. 13. Note: the taper of frustro-conical outer wall 54 is exaggerated in the figures for better understanding of the principle of operation. It is contemplated that the taper will be relatively slight, much less than what is shown.

Wedge member 52 has a half-cylindrical tubular top 64 with coaxial, parallel inner and outer walls 66, 68 respectively. Top 64 is sized to enable installation by relatively gentle hammering. Hole 70 is provided for removal of wedge member 52. Wedge member top inner wall 66 is contiguous with the bottom inner wall 56. Wedge member bottom half frustro-conical outer wall 54 is tapered inwardly from the wedge member top 64 to a bottom end 72 of the wedge member 52.

The socket 20 and wedge member 22 are preferably formed of a thermoplastic material selected from the group consisting of polyethylene and polypropylene.

Examples of the socket and wedge member have been formed from DRISCOPLEX (TM) PE 3408 HDPE. It is anticipated that a portion of the material may include recycled rubber, such as ground vehicle tires.

The wedge member 22 may be used in conventional metal sockets as well as the socket shown herein, providing a reduction of hazard over the conventional metal driven-in fastener.

It will be understood that each of the elements described above, or two or more together, may also find a useful application in other types of constructions differing from the type described above.

While the invention has been illustrated and described as embodied in a braking systems, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

Whereas, the present invention has been described with respect to a specific embodiment thereof, it will be understood that various changes and modifications will be suggested to one skilled in the art and it is intended to encompass such changes and modifications as fall within the scope of the appended claims.

What is claimed is:

1. A post and post mount assembly in a hole in the ground having interior walls, comprising:

a socket in the hole;

concrete in the annular space between the interior walls of the hole and the exterior of the socket;

a post in the socket;

a wedge member having a tapered portion filling a gap between the socket and the post;

with the socket being a cylindrical tube with coaxial, parallel inner and outer walls; and with the socket having a lower end at an oblique angle to the inner and outer walls.

2. The assembly of claim 1 with the lower end of the socket having inner and outer elliptical edges.

3. The assembly of claim 1 with the oblique angle of the socket lower end being about thirty degrees from perpendicular to the inner and outer walls.

4. The assembly of claim 2, with the socket having walls defining a locking port, and with the uppermost portion of the locking port being about level with the uppermost portion of the inner elliptical edge, with concrete forming a floor within the socket lower end about level with the uppermost portion of the locking port and extending through the locking port.

5. The assembly of claim 4 with concrete in the annular space between the interior walls of the hole and the exterior of the socket forming a contiguous mass with the concrete in the locking port.

6. A post and post mount assembly in a hole in the ground having interior walls, comprising:

a socket in the hole;

concrete in the annular space between the interior walls of the hole and the exterior of the socket;

a post in the socket;

a wedge member having a tapered portion filling a gap between the socket and the post; and with the post being cylindrical, having an exterior wall sized with a diameter smaller than the inner wall of the socket, and the wedge member having a bottom with a half frustro-conical outer wall and a half-cylindrical inner wall, the half frustro-conical wall being tightly engaged with a socket upper end inner circular edge and the post exterior wall.

7. The assembly of claim 6 with the wedge member having a half-cylindrical, tubular top with coaxial, parallel inner and outer walls.

8. The assembly of claim 7 with the wedge member top inner wall being contiguous with the bottom inner wall.

9. The assembly of claim 6 with the wedge member bottom half frustro-conical wall being tapered inwardly from the wedge member top to a bottom end of the wedge member.

10. A post and post mount assembly fixed in a cylindrical, vertical hole in the ground having interior walls, comprising:

a socket in the hole;

the socket being formed of a thermoplastic material;

the socket thermoplastic material selected from the group consisting of polyethylene and polypropylene;

the socket being a cylindrical tube with coaxial, parallel inner and outer walls;

the socket having an upper end perpendicular to the inner and outer walls;

the upper end of the socket having inner and outer circular edges;

the socket having a lower end at an oblique angle to the inner and outer walls;

the lower end of the socket having inner and outer elliptical edges;

the oblique angle of the socket lower end being about thirty degrees from perpendicular to the inner and outer walls;

the lower end of the socket having walls defining a locking port;

the uppermost portion of the locking port being about level with the uppermost portion of the inner elliptical edge, with concrete forming a floor within the socket lower end about level with the uppermost portion of the locking port and extending through the locking port;

concrete in the annular space between the interior walls of the hole and the exterior of the socket forming a contiguous mass with the concrete in the locking port; a cylindrical post in the socket having an exterior wall sized with a diameter smaller than the inner wall of the socket;

a wedge member having a tapered portion filling a gap between the socket and the post; the wedge member being formed of a thermoplastic material; the wedge member thermoplastic material selected from the group consisting of polyethylene and polypropylene;

the wedge member having a half-cylindrical, tubular top with coaxial, parallel inner and outer walls;

the wedge member having a bottom with a half frustro-conical outer wall and a half-cylindrical inner wall;

the wedge member top inner wall being contiguous with the bottom inner wall; the wedge member bottom half frustro-conical wall being tapered inwardly from the wedge member top to a bottom end of the wedge member;

the half frusto-conical wall being tightly engaged with the socket upper end inner circular edge and the post exterior wall.

* * * * *